US007251972B2

(12) United States Patent
Schulz

(10) Patent No.: US 7,251,972 B2
(45) Date of Patent: Aug. 7, 2007

(54) METHOD AND DEVICE FOR RESHAPING TUBES

(75) Inventor: Luca Schulz, Krefeld (DE)

(73) Assignee: Wilhelm Schulz GmbH, Krefeld (DE)

( * ) Notice: Subject to any disclaimer, the term of this patent is extended or adjusted under 35 U.S.C. 154(b) by 417 days.

(21) Appl. No.: 10/496,240

(22) PCT Filed: Nov. 19, 2002

(86) PCT No.: PCT/DE02/04310

§ 371 (c)(1),
(2), (4) Date: May 21, 2004

(87) PCT Pub. No.: WO03/045604

PCT Pub. Date: Jun. 5, 2003

(65) Prior Publication Data

US 2005/0000259 A1 Jan. 6, 2005

(30) Foreign Application Priority Data

Nov. 21, 2001 (DE) ..... 101 56 978
Sep. 5, 2002 (DE) ..... 102 41 641

(51) Int. Cl.
*B21D 26/02* (2006.01)
*B23P 23/00* (2006.01)
*B21B 37/00* (2006.01)

(52) U.S. Cl. ..... 72/58; 72/61; 72/62; 29/421.1

(58) Field of Classification Search ..... 72/58, 72/60, 61, 62; 29/421.1
See application file for complete search history.

(56) References Cited

U.S. PATENT DOCUMENTS 4,292,828 A 10/1981 Germann
4,364,251 A 12/1982 Nishihara et al.
5,097,689 A * 3/1992 Pietrobon ..... 72/58
5,815,901 A * 10/1998 Mason et al. ..... 72/58
5,992,197 A * 11/1999 Freeman et al. ..... 72/62
6,014,879 A * 1/2000 Jaekel et al. ..... 72/61
6,397,449 B1 * 6/2002 Mason et al. ..... 29/421.1
6,446,476 B1 * 9/2002 Gmurowski ..... 72/58
6,493,913 B2 * 12/2002 Streubel et al. ..... 72/58
6,502,822 B1 * 1/2003 Brown ..... 72/62

* cited by examiner

*Primary Examiner*—David Jones
(74) *Attorney, Agent, or Firm*—Cohen Pontani Lieberman & Pavane LLP

(57) ABSTRACT

A method and an apparatus for reshaping a tube having an initial outside diameter, an initial wall thickness, and an initial length to form a tube have a reshaped outside diameter, a reshaped length, and a reshaped wall thickness, wherein at least one of the reshaped outside diameter, the reshaped length, and the reshaped wall thickness is different than a respective one of the initial outside diameter, the initial wall thickness, and the initial length. The method includes mounting the tube between two axially displaceable pressure rams with the ends of the tube against respective rams; applying an internal hydraulic pressure to the tube; applying an axial mechanical pressure to the tube via the rams; and simultaneously and uniformly cold-working the tube over its entire length by adjusting the internal hydraulic pressure and the axial mechanical pressure as a function of the reshaped outside diameter, the reshaped wall thickness, and the reshaped length.

14 Claims, 1 Drawing Sheet

METHOD AND DEVICE FOR RESHAPING TUBES

PRIORITY CLAIM

This is a U.S. national stage of application No. PCT/DE02/04310, filed on 19 Nov. 2002. Priority under 35 U.S.C. §119(a) and 35 U.S.C. §365(b) is claimed from German Application No. 101 56 978.5, filed 21 Nov. 2001 and German Application No. 102 41 641.9, filed 5 Sep. 2002.

BACKGROUND OF THE INVENTION

1. Field of the Invention

The present invention concerns a method for reshaping tubes and a device for carrying out this method.

2. Description of the Related Art

To produce tubes, especially tubes with relatively large diameters, it is known that open seam tubes can be shaped from rolled sheet or strip and then welded along the longitudinal edges. Steel tubes of this type are suitable for very high pressures and are characterized by relatively great precision with respect to their wall thicknesses and surface finish. They are used in special applications that require high load limits such as in power plants and in the petrochemical industry. A disadvantage of this method is that precision production of the tubes is extremely time-consuming and thus cost-intensive due to the required rolling to final dimension.

Another well-known method is hydroforming, in which a tube section that serves as the starting material is used to produce complex hollow structural components of a desired geometry by cold working without a heat treatment. As a rule, an external shaping tool with an internal shape corresponding to the desired geometry of the component is used. The application of high hydraulic pressure to the interior of the tube section has the effect of bringing the tube section into the desired shape. This hydroforming method is used to produce complex hollow structural components such as housings for pipeline fittings, for example, as described in the published international patent application WO 99/52, 659.

Furthermore, it is known from DE-AS 1 081 856 that relatively thin-walled tubes can be easily expanded by internal hydraulic pressure for the purpose of sizing the tubes. In this method, an external forming tool is used, which consists of a series of slit sleeves. These sleeves constitute a forming die, which tightly surrounds the tube during the expansion process. In this known method, the production of expanded tubes requires expensive actuating mechanisms for each pair of half-sleeves of the forming die. Moreover, because the wall of the tube is relatively thin to begin with, the diameter of the tube can be expanded to only limited extent by this method. It is not possible to produce tubes with significantly larger diameters.

SUMMARY OF THE INVENTION

The goal of the present invention is to develop a method by means of which tubes with a wide range of diameters and a wide range of wall thicknesses can be easily produced. The invention also pertains to a device for carrying out this method.

In particular, the invention pertains to a method for reshaping a tube by means of hydraulic pressure introduced inside the tube, which has an initial outside diameter, an initial wall thickness, and an initial length, and which is mounted between two axially displaceable pressure rams, to form a finished tube with a different outside diameter or different length, and/or a different wall thickness compared to the initial tube, where the initial tube is simultaneously and uniformly cold-worked over its entire length, and where the level of the internal hydraulic pressure, the axial displacement of the pressure rams, and the pressure exerted by rams on the ends of the tube are mutually adjusted in such a way that the outside diameter is increased and the wall thickness is simultaneously reduced, this being accomplished by raising the internal hydraulic pressure while maintaining the axial distance between the pressure rams;

the outside diameter is increased, the wall thickness is kept the same, and the length of the tube is decreased, this being accomplished by raising the internal hydraulic pressure while reducing the axial distance between the pressure rams; and the length of the tube is decreased and wall thickness is increased, this being accomplished by maintaining the internal hydraulic pressure while reducing the axial distance between the pressure rams and maintaining the initial outside diameter of the tube.

The heart of the invention is the systematic mutual adjustment of the internal pressure $P_H$ and the axial pressure $P_M$ as a function of the required wall thickness and outside diameter, under consideration of the type of material of which the tube is made. Compared to previous methods for producing hollow profiles, especially tubes of large diameter, such as hot working or precision sizing, the invention has the advantage that it is possible to produce tubes with a relatively large diameter/wall thickness ratio, which can withstand even high pressure loads at minimal wall thicknesses. Cold working by means of high internal pressures makes it possible to produce hollow profiles that meet quality requirements and make additional quality tests unnecessary. The reason for this is that, in principle, the tube has already been subjected to the required pressure test during the forming process itself. In addition, production times afforded by the method of the invention are considerably shorter than those of the conventional methods for producing tubes of relatively large diameter, for example. Another advantage is that it is possible to produce tubes even from relatively expensive materials with the use of less material than before. The reason for this is that, because of the enhanced strength properties resulting from the strain hardening that occurs during the forming process and/or because of the narrower wall thickness tolerances which can be maintained, even large-diameter tubes can be formed with relatively thin walls while still fulfilling the same load specifications such as the maximum permissible stress.

A special advantage of the method of the invention is that specific customer wishes with respect to outside diameter and wall thickness can be satisfied quickly and easily by suitable adjustment of the forming conditions without any need for time-consuming and expensive retooling.

An important consideration with respect to the reshaping itself is that it is carried out continuously and at a constant rate from the initial workpiece to the finished tube.

In this regard, the degree of reshaping can be selected as a function of the material so that a microstructural transformation leading to strain hardening occurs.

So that a wide range of outside diameters, wall thicknesses and, ultimately, tube lengths can be achieved, it is necessary to coordinate the various reshaping conditions with each other. These conditions include the axial displacement of the pressure rams and the change of the internal pressure in the tube to be reshaped. In this regard, it must also be considered, for example, that, when the outside diameter of the tube is being increased, the internal pressure is reduced and the pressure exerted by the rams on the ends of the tube is adjusted.

It is also important for the method that the pressure rams act only on the surfaces of the ends of the tubes facing them. The mounted tube thus essentially undergoes free deformation, i.e., there is no longer any need for the die block used in the conventional methods. This is also basically true even if the outside diameter is not to be enlarged, i.e., if only the wall thickness is to be increased. In this case, the wall is supported to a certain extent only in the initial stage, for the thicker the wall becomes, the more its inherent strength becomes sufficient.

The axial distance between the pressure rams can be changed by moving one or both of the rams.

The method of the invention is especially advantageous in cases where the reshaped tubes have an outside diameter greater than 219 mm, where the outside diameter is to be increased to at least 1.5 times the original outside diameter in a single operation, and where a seamless tube is used as the starting tube.

Precision tubes for special applications can thus be produced and material savings realized simultaneously by means of the inventive method in a surprisingly simple way and with highly precise results, i.e., a result that falls within narrow tolerance ranges. Naturally, the internal pressure $P_H$ and the axial pressure $P_M$ are adjusted relative to each other so that the internal pressure is always above a value that prevents the tube from buckling under the effect of the compressive forces, and also so that the diameter of the hollow profile is expanded or enlarged continuously in manner which produces the desired or required wall thickness or in a manner which produces simultaneously the desired or required wall thickness and length of the profile.

The ratio between the size of the outside diameter before hydroforming and the size after hydroforming is more than 1:1.5 and, within the given material-dependent limits, the ratio between the original diameter and the final diameter can be as high as 1:3. This means that tubes with large diameters can be produced from tubes or hollow sections with relatively small diameters. The method is cost-effective and easier to carry out than conventional production methods such as the rolling or hot working of large-diameter tubes. Large diameters are understood to mean a range of outside diameters from 219 mm to more than 1,000 mm.

It is advantageous if the given process parameters, especially the internal pressure $P_H$ that is applied, the axial pressure $P_M$ that is applied, and the axial distance traveled by the pressure rams, are all stored as a function of the material and the geometry of the tube section used as the starting tube and of the finished tube that is ultimately obtained. These stored data can then be used as reference data for the fulfillment of specific customer wishes, i.e., for the production of special tubes, and they can be continuously supplemented by parameters subsequently obtained. Quality and production reliability can thus be increased and production waste significantly reduced.

The inventive device for reshaping a tube by the method of the invention includes two axially aligned pressure rams, at least one of which is supported in such a way that it can be axially displaced relative to the other and can be moved in a continuously variable way by a displacement drive, where their end surfaces are designed as flat contact surfaces for the tube to be mounted;

a pressure-generating unit for building up the internal pressure in the mounted tube; and a control unit, by which the axial movement of the pressure rams, the pressure exerted by the rams against the end surfaces of the mounted tube, and the level of the internal pressure can be adjusted independently of one another.

In accordance with an advantageous design, a centering device is provided, by which the tube to be mounted can be aligned relative to the pressure rams.

In addition, sealing elements are provided on the end surfaces of the pressure rams to seal the transitions between the rams and the ends of the mounted tube.

A support that defines the external dimensions of the tube to be reshaped can be inserted between the pressure rams.

This support can consist of several shell-like segments, which together form a closed die.

The device can be used to produce tubes with larger diameters, e.g., diameters greater than 219 mm, and with very small wall thicknesses by cold working. These tubes can have wall thicknesses that are very close to the minimum wall thicknesses required by various regulatory codes to ensure that defined load conditions can be withstood. Such regulatory codes include the ISO, EN, and DIN specifications, for example. Since the control unit allows systematic adjustment of the pressing operation in such a way as to obtain the final result, i.e., the geometry of the tube to be produced, precision tubes can be obtained in a very simple and timesaving way.

It has already been mentioned that the reshaping process can lead to strain hardening; specifically, this occurs by the transformation of the microstructure of the material brought about by expansion and stretching. Compared to the tubes produced by the conventional methods, i.e., untreated tubes, a tube produced by the present method has a uniformly fine microstructure. This finer microstructure results in improved strength values and at the same time very small tolerance deviations. An essential aspect here is that all of this is achieved in a single operational step, namely, the reforming operation itself, and thus no additional, cost-intensive heat treatment is required.

The strain hardening generally increases the strength values of the tube, especially the offset yield stress and the tensile strength, which is why a tube of this type has greater strength properties at a relatively thin wall thickness than hollow profiles produced by hot-working. Compared, for example, to metal tubes produced by rolling methods, a metal tube produced by the method of the invention has the advantage that the surfaces and the wall thicknesses can be produced within very small tolerance ranges. The dimensional deviations caused by rolling operations during hot-working are not present here.

In accordance with a preferred embodiment, the hollow profile has an actual wall thickness at or slightly above the theoretical minimum wall thickness. The amount by which the tolerance is exceeded is significantly less than that of precision tubes. In particular, the thickness of the hollow profile to be produced deviates by less than 5% from the minimum thickness required for a tube wall with a certain compressive strength. Compared to tubes produced by conventional methods, this small size deviation results in material savings, which is advantageous especially in the case of special materials and expensive metal alloys and in specific applications where weight is problem.

DETAILED DESCRIPTION OF THE PRESENTLY PREFERRED EMBODIMENTS

Figure 1:
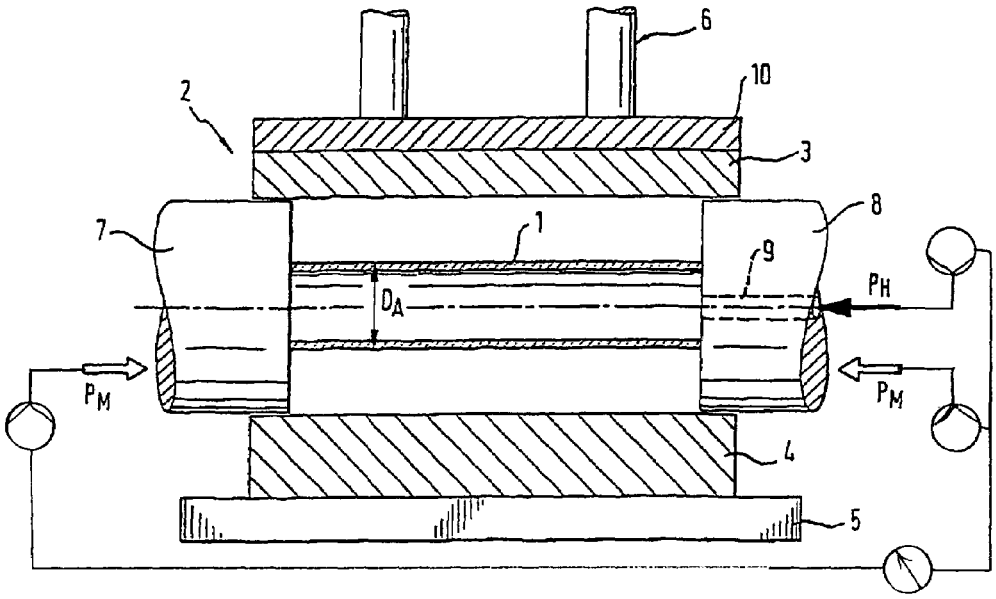
FIG. 1 shows a schematic cross section of a press in accordance with the invention with a section of tube of small diameter as the starting piece before the method of the invention has been applied.

To illustrate the invention, FIG. 1 shows a schematic cross section of a press of the invention, in which a tube section 1, which has an initial diameter $D_A$ and serves as the starting piece, is mounted inside a pressing tool 2, which consists of an upper die part 3 and a lower die part 4. The two halves of the die are provided, respectively, on a machine foundation 5 and a pressing device 6, which acts from above and which hold the two-part die closed during the expansion of the tube section 1 by high internal pressure. Pressure rams 7, 8 are provided on either side. They seal the end surfaces of the tube section 1 to allow the application of a high internal hydraulic pressure $P_H$, and at the same time they exert a mechanical force $P_M$ in the axial direction on the tube 1. The pressure ram 8 on the right has a central through-hole 9, through which a hydraulic fluid can be supplied from a pressure-generating unit (not shown) to the interior of the tube section 1. The two die halves 3, 4, i.e., the upper die part 3 and the lower die part 4, have a uniform inside shape, which corresponds to the final diameter $D_E$ of the tube section 1 to be produced, and they are mounted in the press in such a way that they can be replaced when desired. The upper die part 3 is mounted on the upper ram 10, whereas the lower die part 4 is interchangeably mounted on the machine foundation 5.

Figure 2:
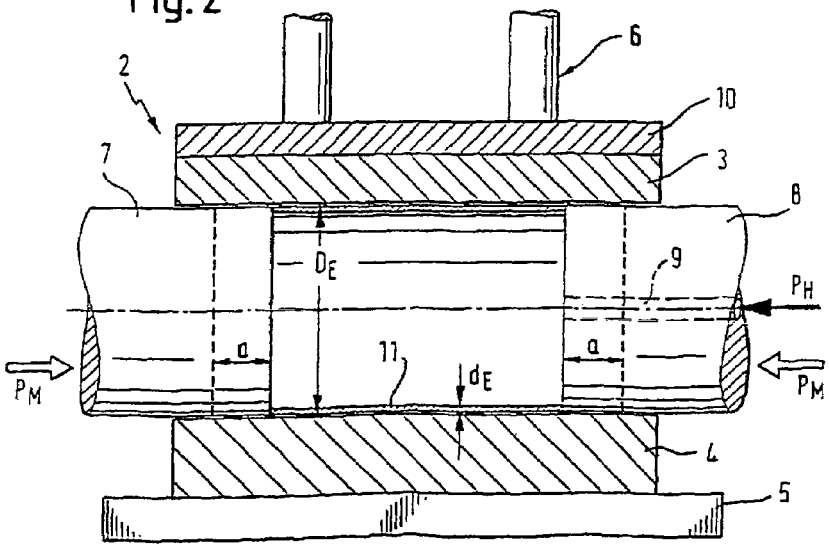
FIG. 2 shows a schematic cross section of the press in FIG. 1 with a section of tube of large diameter after the method of the invention has been applied.

When the method of the invention is carried out, as is illustrated by the arrows in FIG. 1, a high internal hydraulic pressure $P_H$ is applied to the tube section 1 by a hydraulic pump, and a mechanical pressure $P_M$ is simultaneously applied in the axial direction to the tube section 1 by the pressure rams 7, 8 driven by displacement devices. These pressures are adjusted relative to each other by a controller, so that the desired geometry of the target metal tube 11 can be obtained in a highly precise way, i.e., within narrow size tolerances, as FIG. 2 shows. The hydraulic pump, the displacement drives, and the controller are indicated schematically in FIG. 1.

As FIG. 2 shows, the method of the invention has the effect of completely reforming the metal tube 11, i.e., of pressing it all the way to the inside surface of the upper die part 3 and of the lower die part 4, resulting in the formation of the desired wall thickness $d_E$ of the tube section 1 to be produced with size deviations of less than 5% of the target minimum wall thickness. The high hydraulic internal pressure $P_H$, the mechanical axial pressure $P_M$ exerted by the lateral pressure rams 7, 8, and the axial displacement "a" of the pressure rams are adjusted in such a way that it is possible to produce a metal tube with the precise wall thickness $d_E$, despite the approximately twofold increase in diameter shown in this specific example. The tube 11 that is produced is shorter than the initial tube section 1 in correspondence with the required wall thickness $d_E$ and degree of expansion. This makes it possible to produce precision tubes with large diameters and very thin walls in only a single, surprisingly simple production step. The invention thus allows the production of special tubes, especially from expensive materials, in a very simple way.

The possibilities offered by the method of the invention are explained below by several examples.

The initial product in each case is an NPS 8", Sched. 80S (12.70 mm), length 6.00 m.

1. Without changing the diameter but by increasing the wall thickness and reducing the length, it is possible to produce:

Sched. 100 (15.06 mm) tubes with a length of 5.12 m
Sched. 120 (18.24 mm) tubes with a length of 4.29 m
Sched. 140 (20.62 mm) tubes with a length of 3.84 m
Sched. 160 (23.01 mm) tubes with a length of 3.49 m
Sched. xxs (22.23 mm) tubes with a length of 3.59 m 2. By increasing the diameter without changing the wall thickness and by reducing the length, it is possible to produce:

NPS 10" Sched. 80 length 4.76 m
NPS 12" Sched. 80 length 3.98 m
NPS 14" Sched. 80 length 3.48 m
NPS 16" Sched. 80 length 3.15 m
NPS 18" Sched. 80 length 2.79 m
NPS 20" Sched. 80 length 2.50 m
NPS 22" Sched. 80 length 2.27 m
NPS 24" Sched. 80 length 2.08 m 3. By increasing the diameter and reducing the wall thickness without changing the length, it is possible to produce the following tubes:

Sched. 40 S(+) NPS 10" 10.19 mm
Sched. 30(+) NPS 12" 8.59 mm
Sched. 20(−) NPS 14" 7.84 mm
Sched. 1 (+) NPS 16" 6.86 mm
Sched. 10(−) NPS 18" 6.09 mm
Sched. 10 S NPS 20" 5.48 mm
Sched. 10 S(−) NPS 22" 4.99 mm
NPS 24" 4.57 nm These examples show the variety of possibilities for producing tubes of highly varied dimensions starting from one set of initial dimensions.

The invention claimed is:

1. A method of reshaping a tube having an initial outside diameter, an initial wall thickness, and an initial length to form a tube have a final outside diameter, a final length, and a final wall thickness, wherein at least one of the final outside diameter, the final length, and the final wall thickness is different than a respective one of the initial outside diameter, the initial wall thickness, and the initial length, the method comprising:

mounting the tube between two axially displaceable pressure rams with the ends of the tube against respective rams;

applying an internal hydraulic pressure to the tube;

applying an axial mechanical pressure to the tube via the rams; and uniformly cold-working the tube over its entire length to simultaneously expand and shorten the tube by adjusting the internal hydraulic pressure and the axial mechanical pressure as a function of the final outside diameter, the final wall thickness, and the final length.

2. A method as in claim 1 wherein the outside diameter is increased, the wall thickness is kept the same, and the length of the tube is decreased by raising the internal hydraulic pressure and raising the axial mechanical pressure so that the axial distance between the rams is reduced.

3. A method as in claim 1 wherein the initial tube is reshaped continuously and at a constant rate.

4. A method as in claim 1 wherein the tube is reshaped to a degree which is selected as a function of the material of the initial tube so that the material of the finished tube is strain hardened.

5. A method as in claim 1 wherein the outside diameter of the tube is increased while the internal hydraulic pressure is reduced and the axial mechanical pressure is adjusted.

6. A method as in claim 1 wherein the rams act only on the ends of the tubes.

7. A method as in claim 1 wherein the axial distance between rams is reduced by moving one of the rams.

8. A method as in claim 1 wherein the final outside diameter is greater than 219 mm.

9. A method as in claim 1 wherein the tube is reshaped in a single operation so that the outside diameter is at least 1.5 times the initial outside diameter.

10. A method as in claim 1 wherein the initial tube is a seamless tube.

11. An apparatus for reshaping an initial tube having an initial outside diameter, an initial wall thickness, and an initial length to form a finished tube having a final outside diameter, a final length, and a final wall thickness, wherein at least one of said final outside diameter, the final length, and the final wall thickness is different than a respective one of the initial outside diameter, the initial wall thickness, and the initial length, the apparatus comprising:

two axially aligned pressure rams having respective flat end surfaces for contacting the ends of the tube, at least one of the rams being supported so that it can be axially displaced relative to the other ram and can be moved in a continuously variable way by a displacement drive;

a pressure generating unit for building up hydraulic pressure in a tube mounted between the flat end surfaces of the rams; and a control unit which can independently and simultaneously adjust the axial displacement of the pressure rams, the pressure which the rams exert on a tube mounted between the rams, and the hydraulic pressure in the tube.

12. An apparatus as in claim 11 further comprising a support that can be positioned around the tube, the support having an internal diameter which corresponds to the final outside diameter of the finished tube.

13. An apparatus as in claim 12 wherein said support comprises a closed die.

14. An apparatus as in claim 13 wherein said support comprises a plurality of segments which together form said closed die.

* * * * *